US005830288A

United States Patent [19]

Gigliotti, Jr. et al.

[11] Patent Number: 5,830,288

[45] Date of Patent: Nov. 3, 1998

[54] TITANIUM ALLOYS HAVING REFINED DISPERSOIDS AND METHOD OF MAKING

[75] Inventors: Michael Francis Xavier Gigliotti, Jr., Scotia; Ernest Leroy Hall, Schenectady, both of N.Y.

[73] Assignee: General Electric Company, Schenectady, N.Y.

[21] Appl. No.: 619,225

[22] Filed: Mar. 20, 1996

Related U.S. Application Data

[63] Continuation-in-part of Ser. No. 312,381, Sep. 26, 1994, abandoned.

[51] Int. Cl.[6] ..... C22C 14/00

[52] U.S. Cl. ..... 148/407; 148/421; 148/669; 148/671; 420/417

[58] Field of Search ..... 148/407, 421, 148/669, 671; 420/417, 418

[56] References Cited

U.S. PATENT DOCUMENTS

| | | | |
|---|---|---|---|
| 3,622,406 | 11/1971 | Vordahl . | |
| 3,679,403 | 7/1972 | Bomberger et al. . | |
| 3,963,525 | 6/1976 | Bomberger et al. | 148/421 |
| 4,576,660 | 3/1986 | Rowe | 148/407 |
| 4,601,874 | 7/1986 | Marty et al. | 419/23 |

*Primary Examiner*—John Sheehan

*Attorney, Agent, or Firm*—Ernest G. Cusick; William H. Pittman

[57] ABSTRACT

Additions of a first alloy constituent of at least one element from the group consisting of Y, Sc, La, Ce, Pr, Nd, Pm, Sm, Eu, Gd, Tb, Dy, Ho, Er, Tm, Yb, and Lu, or any combinations of them, and a second alloy constituent of at least one element from the group consisting of C, Si, Ge, Sn and Pb, or any combinations of them, to Ti-base alloys can be employed so as to result in an alloy containing an very fine, substantially homogeneous oxide dispersoid of the first constituent, and produce alloys having improved tensile properties, especially tensile elongation. The dispersoid results from the decomposition of an intermediate phase dispersoid comprising a compound of the first and second constituents which results from rapid solidification of the alloy from a melt. It is preferred that the second alloy constituent should be at a concentration sufficient to form the intermediate phase with all of the element or elements comprising the first alloy constituent.

18 Claims, 4 Drawing Sheets

TITANIUM ALLOYS HAVING REFINED DISPERSOIDS AND METHOD OF MAKING

CROSS-REFERENCE TO RELATED APPLICATION

This application is a continuation-in-part of copending application Ser. No. 08/312,381 now abandoned, filed on Sep. 26, 1994.

BACKGROUND OF THE INVENTION

The present invention is directed generally to titanium alloys having refined dispersoids of rare earth oxide particles and a method of making these alloys. More particularly, the alloys comprise Ti-base alloys having at least one element from a first group consisting of Sc, Y, La, Ce, Pr, Nd, Pm, Sm, Eu, Gd, Tb, Dy, Ho, Er, Tm, Yb, and Lu and at least one element from a second group consisting of C, Si, Ge, Sn, and Pb, and having a fine dispersoid of an oxide of an element from the first group distributed substantially homogeneously throughout the alloy. The method comprises the development of a substantially homogeneously distributed fine intermediate phase within an alloy of the type described above which consists of at least one of the elements from each of the first and second groups. The alloy containing the intermediate phase is subsequently heat treated so as to cause the oxidation of the intermediate phase, thereby creating a fine dispersoid of an oxide of the metal or metals from the first group.

The use of yttrium and the rare earth metals to form stable dispersoids in a titanium matrix was described in U.S. Pat. Nos. 3,622,406 and 3,379,522. A dispersoid in this context was described as a dispersion of insoluble precipitates within the matrix of a given alloy. In these references, the alloys included insoluble precipitates in the form of oxides of yttrium and the rare earth metals. These references, however, did not recognize any special advantage with respect to the distribution of the dispersoid due to the presence of Sn or another Group IV-A element in the alloy.

In U.S. Pat. No. 4,512,826, precipitation strengthening of titanium alloys was described where the precipitate was a compound of yttrium or a rare earth metal with metals of Group III-A or IV-A. This patent, however, describes the necessity of taking particular care to preserve the stability of the precipitate, and thus does not describe a subsequent heat treatment of these precipitates to cause their decomposition by oxidation and the resultant formation in their place of a fine dispersoid of an oxide of yttrium or another rare earth metal or metals.

Yet another reference describes a class of titanium alloys based on $Ti_3Al$ (commonly referred to as "alpha-two") and having a dispersoid of rare earth oxides, see *Comparison of Melt Spun and Consolidated $Ti_3Al$-Nb Alloys With and Without a Dispersoid;* R. G. Rowe, J. A. Sutliff, E. F. Koch; Conference Proceedings—Titanium: Rapid Solidification Technology; The Metallurgical Society/AIME; 1986; pages 239–248. These alloys were described as having poor mechanical properties, particularly a reduction of room temperature ductility, when dispersoid forming elements were added to the alloy compositions.

Poor results have also been reported for $Ti_3Al$-base alloys with respect to the improvement of alloy mechanical properties by the addition of rare earth oxide dispersions in *Improved Toughness Alloys Based on Titanium Aluminides;* Report No. WRDC-TC-89-4095; M. J. Blackburn, M. P. Smith; Wright Research and Development Center, Wright-Patterson Air Force Base; Oct. 29, 1989. This report indicated that the addition of rare earth elements to $Ti_3Al$ alloys produced undesirable microstructures characterized by the rare earth compounds segregating to the matrix grain boundaries. The authors concluded on page 202 that, "Prospects for useful rapidly solidified dispersion containing alpha-two alloys look bleak." They also stated, "It does not seem that further work on rare-earth (and related) elements or oxides is warranted."

SUMMARY OF THE INVENTION

It has been determined that Ti-base alloys having at least a first alloy constituent of an elements from the group consisting of Y, Sc, La, Ce, Pr, Nd, Pm, Sm, Eu, Gd, Tb, Dy, Ho, Er, Tm, Yb, and Lu and a second alloy constituent of an element from the group consisting of C, Si, Ge, Sn and Pb can be processed so as to form a very fine, substantially homogeneous distribution of an oxide dispersoid that enhances the room temperature and elevated temperature ductility of these alloys. The oxide dispersoid is produced by the decomposition of a dispersoid of a very fine, substantially homogeneous intermediate phase within the alloy matrix comprising a compound or compounds of the first and second alloy constituents by oxidation of the element or elements comprising the first alloy constituent. This intermediate phase is formed by rapid cooling of the alloy from a melt or from an elevated temperature at which the first and second alloy constituents are in solution within the alloy matrix. The intermediate phase may be decomposed to form the oxide dispersoid by heating at an elevated temperature.

In one of its aspects, therefore, the invention comprises a Ti-base alloy having a substantially homogeneous dispersoid of oxide particles that have a mean diameter of about 1 micron or less; a first alloy constituent comprising at least one element from the group consisting of Y, Sc, La, Ce, Pr, Nd, Pm, Sm, Eu, Gd, Tb, Dy, Ho, Er, Tm, Yb, and Lu; and a second alloy constituent comprising at least one element from the group consisting of C, Si, Ge, Sn and Pb, wherein the dispersoid of oxide particles comprises an oxide of said first alloy constituent, and wherein said second alloy constituent has as a purpose the formation of a substantially homogeneous dispersoid of particles of an intermediate phase having a mean diameter of about 1 micron or less with said first alloying addition, which intermediate phase is subsequently decomposed by thermal processing to form the dispersoid of oxide particles.

Another aspect is a method for making a Ti-base alloy having a substantially homogeneous dispersoid of oxide particles comprising the steps of: melting a Ti-base alloy comprising a first alloy constituent of least one element from the group consisting of Y, Sc, La, Ce, Pr, Nd, Pm, Sm, Eu, Gd, Tb, Dy, Ho, Er, Tm, Yb, and Lu, and a second alloy constituent of at least one element from the group consisting of C, Si, Ge, Sn and Pb; cooling the Ti-base alloy to a temperature at which the elements of the first alloy constituent and the second alloy constituent form an intermediate phase within the alloy comprising a substantially homogeneous dispersoid of particles having a mean diameter of about 1 micron or less; and aging the Ti-base alloy by heat treatment at an elevated temperature and for a time sufficient to cause the decomposition of the intermediate phase and the formation of an oxide of the first alloy constituent, wherein the oxide comprises a substantially homogeneous dispersoid of particles having a mean diameter of about 1 micron or less.

The invention provides Ti-base alloys with predictable and controlled substantially homogeneous dispersoids of oxides from the group consisting of Y, Sc, La, Ce, Pr, Nd, Pm, Sm, Eu, Gd, Tb, Dy, Ho, Er, Tm, Yb, and Lu that have a mean diameter of 1 micron or less. Further, it produces such dispersoids in Ti/Al-base alloys. It also provides a method for making such a dispersoid. A principal advantage of the alloys of the present invention is an improvement in mechanical properties, particularly an increase in their room temperature and elevated temperature ductility when compared to alloys having a similar alloy chemistry without the dispersoid of very fine oxide particles.

DETAILED DESCRIPTION; PREFERRED EMBODIMENTS

Figure 1:
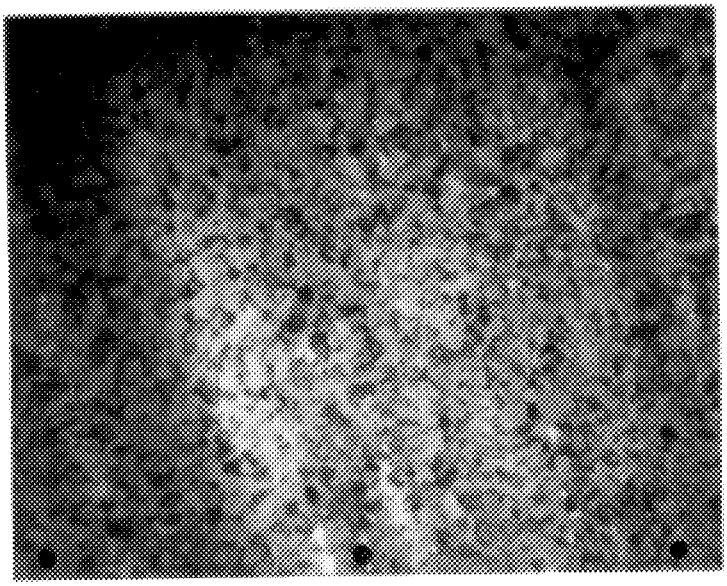
FIG. 1 is a photomicrograph taken at 7500×magnification using transmission electron microscopy (TEM) of an $Er_5Sn_3$ intermediate phase dispersoid within an as-extruded Ti/Al alloy matrix.

As discussed above, it has long been postulated that dispersoids of oxide particles could be used to improve the mechanical properties of Ti-base alloys, but such improvements have not been realized as discussed above, particularly with respect to improvement of the room temperature and elevated temperature ductility. Rather, decreases in room temperature ductility have been observed in alloys containing oxide dispersoids. However, it has been determined that the room temperature and elevated temperature ductility of Ti-base alloys can be improved by a dispersoid of very fine oxide particles, and have discovered alloying constituents and thermal processing conditions for making such a dispersoid.

In order to improve the mechanical properties, particularly the room temperature and elevated temperature ductility, of Ti-base alloys by means of a dispersoid of oxide particles, the oxide particles must be very fine and distributed substantially homogeneously throughout the matrix of the alloy. In this context, improvement in the alloy properties means improvement as compared to a similar alloy composition without a very fine, substantially homogeneous dispersoid of oxide particles. A similar alloy could include an alloy composition identical to alloys of the present invention, but processed such that a coarse dispersoid occurs as described below (e.g. slow cooling from a melt). A similar alloy could also include an alloy having a composition similar to an alloy of the present invention, but lacking either the first or the second alloy constituent, or both.

It has been determined that in order to produce improvements in the room temperature and elevated temperature ductility that the mean diameter of the oxide particles, or the longest dimension in the case of irregular or non-spherical particles, should be about 1 micron, and that it is preferred to have a smaller mean diameter, on the order of 0.1 micron or less. It is also necessary that the dispersoid of oxide particles be distributed substantially homogeneously within the matrix of the alloy. This means that the particles must not be segregated within the alloy matrix, particularly along the grain boundaries.

The oxide particles may be oxides of a first alloy constituent in the form of Y or Er as specifically demonstrated in the examples set forth below. However, it is also believed that other rare earth metals may be used as well, including: Sc, La, Ce, Pr, Nd, Pm, Sm, Eu, Gd, Tb, Dy, Ho, Tm, Yb, and Lu, because (1) they can reduce titanium oxygen solid solutions to form their own stable oxides; and (2) they can form stable intermediate phases with Sn or the other group IV-A elements (C, Si, Ge or Pb). Also, these first alloy constituent metals may be used in combination with one another, such that the oxide dispersoid comprises a mixture of a plurality of oxides, for example Y and Er oxides. These oxides are generally of the type $[RE]_2O_3$, where RE is used to designate one or more of the Group III-B and rare earth metals listed above. The amount of RE metals to be included in an alloy of the present invention should comprise about 3 atomic percent or less, preferably about 0.5–3.0 atomic percent based on total metals, of the alloy.

In order to form a dispersoid comprising a very fine oxide, or oxides, an intermediate phase comprising a compound of the RE metal or metals and a second alloy constituent, comprising Sn, Ge or a combination of these elements, is first formed. Further, it is believed that other elements, or combinations of elements, from Group IV-A may be used together with, or in lieu of, Sn and Ge to form an intermediate phase or phases in Ti-base alloys. These elements include C, Si, and Pb. Group IV-A elements are used: (1) because of their ability to form compounds with the RE metals in the form of a dispersoid of fine particles; and (2) because the RE elements within these intermediate compounds may be oxidized preferentially with respect to the Group IV-A element or elements, so as to form the dispersoid of oxide particles as discussed further below.

The quantity of Group IV-A element, or sum of the these elements if more than one is present, should be at least sufficient to provide enough atoms of this element or elements to satisfy stoichiometric requirements of the [RE] [Group IV-A] compound or compounds to be formed, and preferably an excess of this element or elements should be provided to ensure substantially complete reaction with the RE element or elements. In order to determine the quantity of atoms of the Group IV-A element or elements necessary to at least satisfy stoichiometric requirements, one method would be to examine a binary phase diagram, or phase diagrams in the case of more than one RE or Group IV-A element, to determine the possible compounds that may be formed. Where more than one compound is possible, it may be useful to consult other sources to examine available metallurgical thermodynamic and kinetic data to determine which of the compounds will be preferred, so that an appropriate quantity of the associated Group IV-A element or elements may be used in the alloy formulation.

The very fine, substantially homogeneous dispersoid of the intermediate phase may be formed by rapid cooling of molten Ti-base alloys containing the necessary RE and Group IV-A element or elements, as is discussed further below. The cooling rate must be sufficiently rapid to produce particles of the intermediate phase having a mean diameter, as described above, of about 1 micron, and preferably substantially smaller, on the order of about 0.1 micron.

Subsequent heat treating of a Ti-base alloy containing such an intermediate phase or phases causes the decomposition of the intermediate phase by the oxidation of the element or elements comprising its RE constituent. It is believed that the Group IV-A element or elements goes back into solid solution in the alloy matrix in the vicinity of the original intermediate phase particles upon the oxidation of the RE constituent. For example, in the case of the alloy Ti-11.7Al-1.6Zr-0.7Hf-1.3Sn-0.5Nb-0.15Mo-0.4Si-0.88Er, in atomic percent, one intermediate phase formed was $Er_5Sn_3$. After decomposition of this intermediate phase, the resulting oxide particles were primarily $Er_2O_3$. If a Ti-base alloy containing a RE metal or metals does not contain Sn, Ge or another group IV-A element or elements at a level sufficient to form an intermediate compound using all of the available RE metal or metals, then RE oxides form directly upon cooling the alloy from the melt, as discussed further below. These directly produced oxides are coarser and appear to form a film on the grain boundaries. It is expected that such alloys would have reduced room temperature and elevated temperature ductility as compared to similar alloys having sufficient quantities of the Group IV-A element to react with substantially all of the RE metal or metals.

After selecting a desired alloy composition meeting the requirements set forth above, a very fine, substantially homogeneous dispersoid of intermediate phase particles may be formed by rapidly cooling the alloy from a melt. This method of forming alloys of the present invention is discussed further below, and in the examples discussed herein.

An alloy of the present invention may be formed from a melt of the various constituents using known methods for melting Ti-base alloys, such as arc or induction melting, so that the RE and Group IV-A alloy constituents are in a liquid solution. From the melt, known rapid cooling techniques may be employed, such as gas atomization or melt spinning. It is only necessary that the cooling rate be high enough to achieve a very fine, substantially homogeneous distribution of the intermediate phase particles, such that they have a mean diameter as described above. In general, the cooling rate should be at least about 500° C./sec and preferably at least about 1,000° C./sec.

After cooling an alloy of the present invention, the decomposition of the intermediate phase to oxidize the RE metal or metals may be accomplished by use of a subsequent heat treatment. This heat treatment should be done at a temperature that is lower than the solutionizing temperature for the alloy with respect to the intermediate phase particles, and in some instances low enough that it does not cause undesirable grain growth, and yet high enough to promote the complete decomposition of the intermediate phase within a time period that is commercially useful. It is believed that for most Ti-base alloys, this temperature will be in the range of about 500°–1400° C. The time period for the heat treatment is a function of the heat treatment temperature. Higher temperatures will require shorter time periods, and lower temperatures will require longer time periods. It is further believed that for the range of aging temperatures noted above, that the aging times will be about 30 minutes to 12 hours. For example, for a Ti-11.7Al-1.6Zr-0.7Hf-1.3Sn-0.5Nb-0.15Mo-0.4Si-0.88Er alloy, in atomic percent, at a heat treatment temperature of 600° C., the heat treatment time was 2 hours, and the intermediate phase appeared to be completely decomposed. In the case of most Ti-base alloys, it is not necessary to perform the heat treatment in an oxygen-containing atmosphere, because most Ti-base alloys already have a sufficient quantity of oxygen in solid solution to supply the stoichiometric amount of oxygen necessary to accomplish the complete oxidation of the intermediate phase. On the contrary, it is generally desirable to perform the aging in a non-oxidizing environment, such as a vacuum or an inert gas such as argon.

As will be noted below, a step of mechanical working in the form of extrusion was employed between the steps of solidification and heat treatment in all of the examples. The exact significance of this step is unknown, and thought to not be essential to the steps for forming a dispersoid as described above. However, the step of mechanically working the alloy may play a role in the post-formation development of the dispersoid, and would certainly be expected to be beneficial with regard to minimizing the effect of known defects typically associated with solidification, such as porosity.

The following examples describe several specific embodiments of alloys of the present invention.

EXAMPLE 1

A melt of an alpha Ti/Al-base alloy containing the RE metal erbium and the Group IV-A metal Sn with a composition of Ti-11.7Al-1.6Zr-0.7Hf-1.3Sn-0.5Nb-0.15Mo-0.4Si-0.88Er in atomic percent (designated composition AF2) was rapidly solidified (cooling rate of at least 500° C./sec) in the form of a powder. This powder was compacted by hot isostatic pressing at 840° C. and 207 MPa pressure for 3 hours. The consolidated material was then extruded into a bar at 840° C. and a reduction ratio of 8:1. The extruded bar was given a high temperature heat treatment by heating it above the beta-phase transition temperature of the alloy at 1150° C. for 2 hours. The alloy was then rapidly cooled by quenching in helium gas. This was followed by an aging heat treatment at 600° C. for 8 hours. These heat treatments were performed primarily for grain size and microstructural control; they were not designed so as to optimize the decomposition of the intermediate phase particles.

Figure 2:
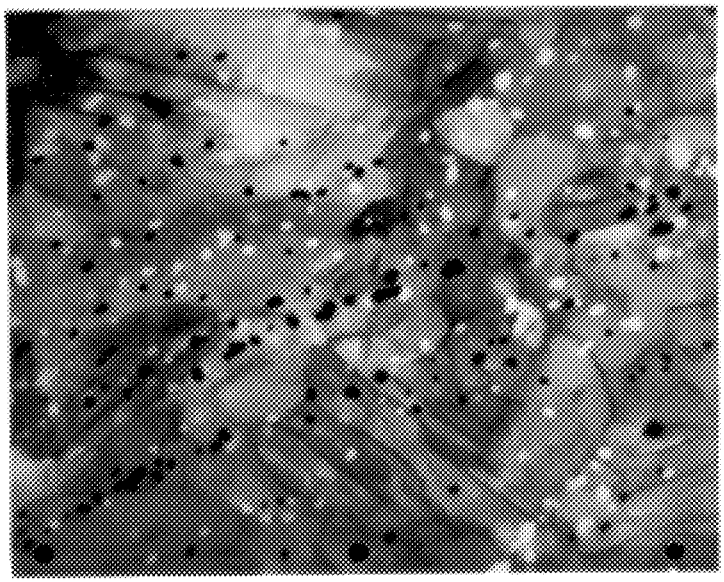
FIG. 2 is a TEM photomicrograph taken at 7500× magnification of the alloy of FIG. 1 after heat treatment, wherein the $Er_5Sn_3$ dispersoid has been converted to a dispersoid of $Er_2O_3$.

The final microstructure consisted of a transformed beta phase matrix with a dispersion of erbium oxide as shown in FIG. 2. A study of the microstructures present before and after the 1150° C. and 600° C. heat treatments was conducted by transmission electron microscopy. The microstructure after extrusion and before any heat treatment consisted of equiaxed alpha titanium alloy grains and a very fine dispersion of an erbium rich phase as shown in FIG. 1. The phase was analyzed to be rich in erbium and tin. Electron diffraction analysis of extracted particles showed a pattern consistent with the compound $Er_5Sn_3$. Based on well known principals relating to precipitation phenomena, it is believed that the intermediate phase particles begin to form during the rapid cooling of the alloy from the melt, and that they are not entirely a result of the extrusion, however, it is also believed that extrusion may contribute to the development of the intermediate phase particles and their distribution.

After the 1150° C. and 600° C. heat treatments, the microstructure consisted of a transformed beta matrix with particles of an erbium rich phase. The erbium rich phase remained as very fine, homogeneously distributed particles, which had a somewhat larger particle size than that prior to the 1150° C. and 600° C. heat treatments. Electron diffraction of the particles revealed them now to be $Er_2O_3$.

The presence of the Sn in the alloy caused the formation of a very fine, substantially homogeneous intermediate phase [RE][Group IV-A] compound, namely $Er_5Sn_3$. This result was unexpected. The fact that such a uniform dispersoid of particles could be developed as a precursor to its decomposition to a dispersoid of an RE oxide having the same small particle size and uniform distribution was also an unexpected result. In general, the concept of using an intermediate phase to form a desired final very fine, substantially homogeneous dispersoid of erbia particles, namely by the intermediate precipitation of an very fine, substantially homogeneous dispersoid of erbium stannide particles, was surprising. It indicated the significance of the addition of a Group IV-A element or elements as an alloy constituent where the creation of a dispersoid of RE oxide particles is desired. This example also demonstrated the significance of alloy processing conditions on the formation of dispersoids of oxide particles, both with respect to the formation of the intermediate phase, and the decomposition of the intermediate phase particles to form the oxide particles.

EXAMPLE 2

Several alpha-2 ($Ti_3Al$) alloys were selected for this study and are listed in Table I. With reference to Table I, all of the alloys contain 1 atomic percent yttrium, which would be expected to form a fine dispersoid of yttria particles if the alloys were rapidly solidified. The composition A50 is a $Ti_3Al$ alloy with an addition of 7.5 atomic percent Nb; the matrix of alloy A50 would be anticipated to be essentially a single phase alloy based on $Ti_3Al$. The composition of alloy A51 is the same as that of alloy A50, except that it contains 2.5 atomic percent tin in the place of aluminum. Tin is known to have a behavior similar to that of aluminum in alloys of this type and therefore, alloy A51 is $Ti_3(Al,Sn)$ with an addition of 7.5 atomic percent Nb. The matrix of A51 would be expected to be, essentially a single phase alloy based on $Ti_3(Al,Sn)$. Alloy A52 is a $Ti_3Al$ alloy with 12.5 atomic percent Nb. The matrix of alloy A52 would be expected to be a two phase alpha-2/beta alloy, with a primary phase based on $Ti_3Al$ and a small amount of a secondary body centered cubic beta phase. The composition of alloy A53 is the same as that of alloy A52, except that it contains 2.5 atomic percent Sn in the place of Al. As noted above, because Sn has a behavior similar to that of Al, alloy A53 is $Ti_3(Al,Sn)$ with an addition of 12.5 atomic percent Nb. The matrix of A53 would be anticipated to be a two-phase alloy, with a primary phase based on $Ti_3(Al,Sn)$ and a small amount of a secondary body centered cubic beta phase.

TABLE I $Ti_3Al$ Dispersoid Compositions (atomic percent)

| Alloy | Ti | Al | Sn | Nb | Y |
|---|---|---|---|---|---|
| A50 | balance | 25.0 | 0 | 7.5 | 1.0 |
| A51 | balance | 22.5 | 2.5 | 7.5 | 1.0 |
| A52 | balance | 25.0 | 0 | 12.5 | 1.0 |
| A53 | balance | 22.5 | 2.5 | 12.5 | 1.0 |

Ingots of the alloys of Table I were prepared by non-consumable arc melting to yield buttons of having a mass of about 375 grams. These buttons were remelted and rapidly solidified (cooling rate of at least 500° C./sec) by melt spinning to yield a ribbon of the respective alloys. The ribbon was consolidated into cylinders by hot isostatic pressing at 840° C. and a pressure of 207 MPa for 3 hours. The consolidated alloy cylinders were thermomechanically processed by extrusion at 840° C. and a reduction ratio of 8:1. The extruded bar was heat treated by heating it above the beta-phase transition temperature of the alloy at 1250° C. for 2 hours. The alloy was then rapidly cooled by quenching in helium gas. This was followed by an aging heat treatment at 760° C. for 2 hours. The heat treatments were not directed to optimize the decomposition of an intermediate phase, but rather were directed to other considerations including grain size and microstructural control of the alloys.

Figure 3:
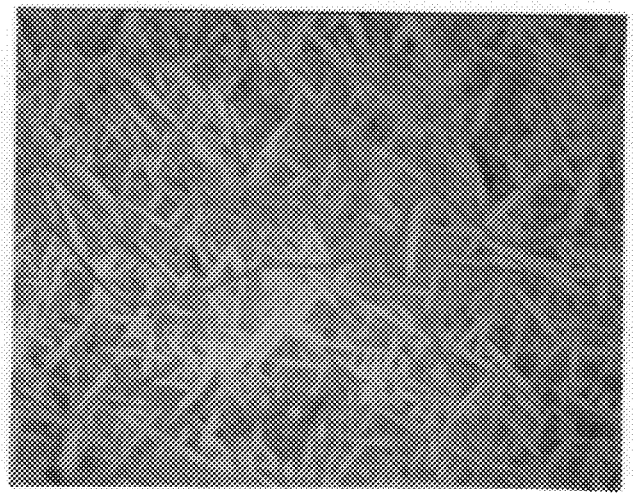
FIG. 3 is an optical photomicrograph taken at 500× magnification of a Ti/Al alloy containing Nb in an as-cast condition.
Figure 4:
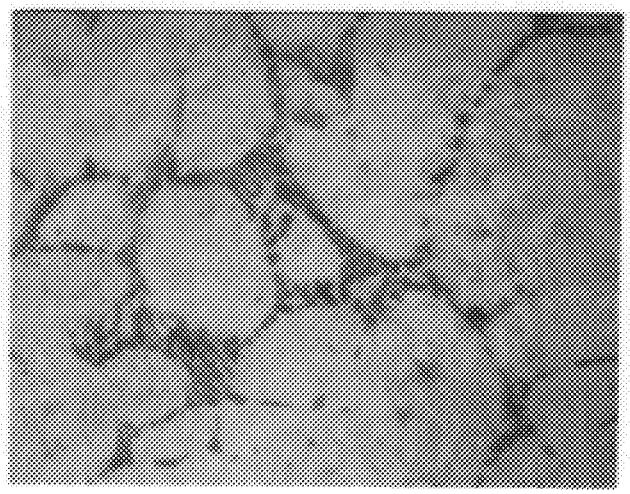
FIG. 4 is an optical photomicrograph taken at 500× magnification of a Ti/Al alloy that is identical to the alloy of FIG. 3, except that it contains 2.5 atomic percent Sn in place of an identical portion of the Al, in an as-cast condition.

The microstructures of the yttrium phase in the arc melted ingots of the $Ti_3Al$ base alloys differ strongly when Sn is present which is, for the reasons noted above, an unexpected result. For the Sn-free alloys, a second phase is present as a continuous film in the grain boundaries of the arc melted ingot. For the alloys containing Sn, a dispersed and discontinuous phase is found throughout the arc melted ingot. This effect on the alloy morphology due to the presence of Sn was unexpected. The differences are illustrated in FIGS. 3 and 4, in which the arc melted structures of alloys A52 (Ti-25Al-12.5Nb-1Y) and A53(Ti-22.5Al-2.5Sn-12.5Nb-1Y), respectively, are displayed.

Figure 5:
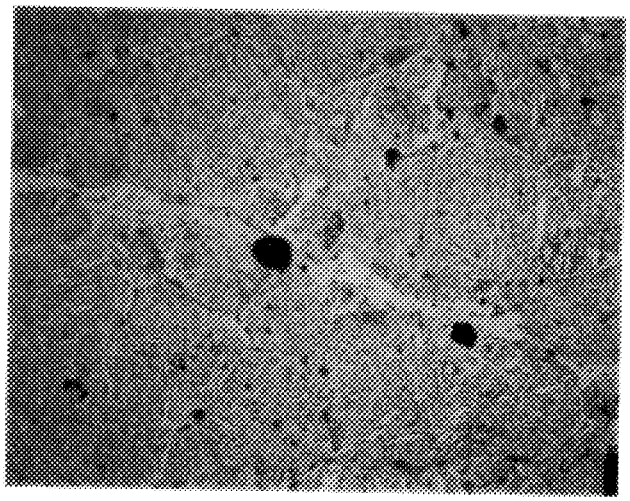
FIG. 5 is an optical photomicrograph taken at 500× magnification of the alloy of FIG. 3 after heat treatment at 1250° C. followed by aging at 760° C.
Figure 6:
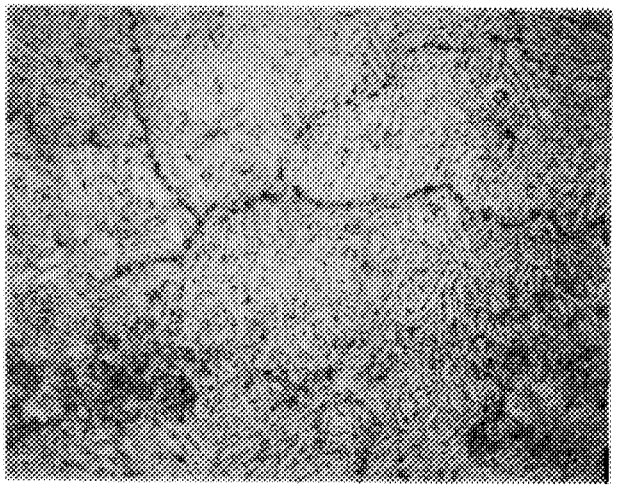
FIG. 6 is an optical photomicrograph taken at 500× magnification of the alloy of FIG. 4 after heat treatment at 1250° C. followed by aging at 760° C.

After thermomechanical processing and the 1250° C. and 760° C. heat treatments, similar microstructural differences occur among the $Ti_3Al$ alloys. For the Sn-free alloys, the second phase is present as a dispersoid of coarse particles as large as 5 microns, and some of the coarsest particles are located in the prior beta grain boundaries of the extruded and heat treated alloy. For the alloys containing Sn the dispersion is much finer, with the largest particles having a mean diameter of 1 micron or less, and more uniform, with the particles distributed substantially homogeneously and not showing any tendency for accumulation along the grain boundaries. The differences are again illustrated in FIGS. 5 and 6, in which the post heat treatment microstructures alloys A52 (Ti-25Al-12.5Nb-1Y) and A53 (Ti-22.5Al-2.5Sn-12.5Nb-1Y), respectively, are displayed.

Tensile tests were conducted at room temperature, 260° C. and 650° C. on these $Ti_3Al$ base alloys in their post heat treated condition. The results are listed in Table II. With reference to Table II, the alloys with 12.5% Nb, alloys A52 and A53, had higher ductilities, measured as percent elongation, than the alloys with 7.5% Nb, alloys A50 and A51. In part, this may have been due to the presence of a ductilizing beta phase within the 12.5% Nb alloys. However, more significant than the increased Nb concentration was the effect due to the addition of Sn. The alloys with Sn, A51 and A53, had significantly higher ductilities than their Sn-free counterparts, alloys A50 and A52, respectively. The alloys without Sn have essentially no room temperature ductility, while the alloys with Sn have 0.17 and 1.4% room temperature tensile elongations. Similarly, at 650° C., the alloys A50 and A52 (without Sn) have tensile elongations of 0.3% and 1.6%, respectively, while the alloys A51 and A53 (with Sn) have tensile elongations of 6.8% and 6.6%, respectively.

TABLE II

Tensile Properties of $Ti_3Al$ Base Alloys Containing Yttrium

| | Temp. | | Yield Strength | | Ultimate Strength | | % |
|---|---|---|---|---|---|---|---|
| Alloy | °C. | °F. | MPa | ksi | MPa | ksi | Elongation |
| A50 | RT | RT | 425 | 61.7 | 425 | 61.7 | 0 |
| A50 | 260 | 500 | 574 | 83.3 | 574 | 83.3 | 0.05 |
| A50 | 650 | 1202 | 488 | 70.8 | 490 | 71.0 | 0.3 |

TABLE II-continued

Tensile Properties of $Ti_3Al$ Base Alloys Containing Yttrium

| | Temp. | | Yield Strength | | Ultimate Strength | | % |
|---|---|---|---|---|---|---|---|
| Alloy | °C. | °F. | MPa | ksi | MPa | ksi | Elongation |
| A51 | RT | RT | 746 | 108.2 | 746 | 108.2 | 0.17 |
| A51 | 260 | 500 | 603 | 87.5 | 721 | 104.5 | 1.7 |
| A51 | 650 | 1202 | 415 | 60.2 | 544 | 78.9 | 6.8 |
| A52 | RT | RT | 657 | 95.3 | 657 | 95.3 | 0 |
| A52 | 260 | 500 | 680 | 98.6 | 680 | 98.6 | 0.2 |
| A52 | 650 | 1202 | 519 | 75.2 | 519 | 75.2 | 1.6 |
| A53 | RT | RT | 675 | 97.9 | 784 | 113.7 | 1.4 |
| A53 | 260 | 500 | 632 | 91.7 | 803 | 116.4 | 3.0 |
| A53 | 650 | 1202 | 527 | 76.5 | 694 | 100.6 | 6.6 |

These results confirm that the addition of a Group IV-A element, in this case Sn, to a second Ti-base alloy (an alpha-2 Ti/Al alloy) also produces a very fine, substantially homogeneous dispersoid of oxide particles. These results also indicate that such a dispersoid produces an improvement in both the room temperature and elevated temperature tensile ductility of these alloys.

EXAMPLE 3

The role of germanium in refining dispersoid structure was discovered to be similar to that of tin. Table III lists three related alloy chemistries. With reference to Table III, alloys ZA, ZB, and ZC are all Sn-free, alpha matrix, titanium alloys containing Er as the RE constituent for forming the dispersoid of oxide particles. Alloys ZA and ZB are modifications of the base alloy ZC, where 1.3 atomic percent Ge is substituted in place of an equal portion of the Al. The alloys were prepared by arc melting, melt spinning (cooling rate of at least 500° C./sec), hot isostatic pressing and extruding, in a manner similar to the alloys of Examples 1 and 2, and particularly Example 2. Extrusion was at 1200° C. The extruded alloys were given a high temperature heat treatment by heating them above the beta-phase transition temperature of the alloy at 1150° C. for 2 hours. The alloy was then rapidly cooled by quenching in helium gas. This was followed by an aging heat treatment at 600° C. for 8 hours. The heat treatments were not directed to optimize the decomposition of an intermediate phase, but rather were directed to other considerations including grain size and microstructural control of the alloys.

TABLE III

Germanium Alloy Chemistries

| | atomic % | | | | | | | | | |
|---|---|---|---|---|---|---|---|---|---|---|
| Alloy | Ti | Al | Zr | Hf | Nb | Mo | Ru | Si | Ge | Er |
| ZA | bal | 11.7 | 1.6 | 0.7 | 0.5 | 0.15 | | 0.35 | 1.3 | 0.88 |
| ZB | bal | 11.7 | 1.6 | 0.7 | 0.5 | | 0.15 | 0.35 | 1.3 | 0.88 |
| ZC | bal | 13.0 | 1.6 | 0.7 | 0.5 | | 0.15 | 0.35 | | 0.88 |

Figure 7:
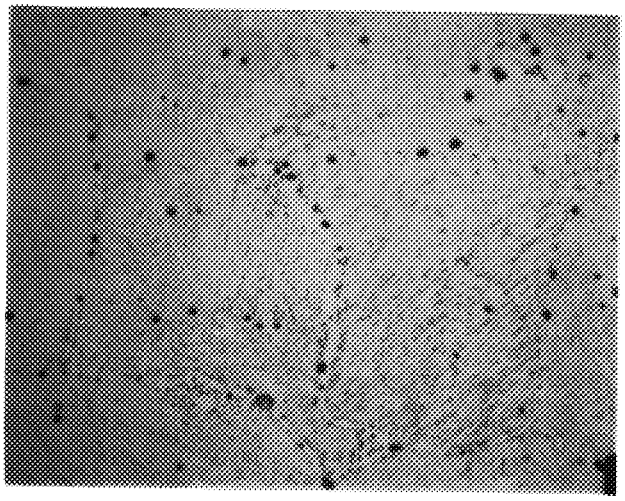
FIG. 7 is an optical photomicrograph taken at 500× magnification of a heat treated Ti/Al alloy containing Nb and Er.
Figure 8:
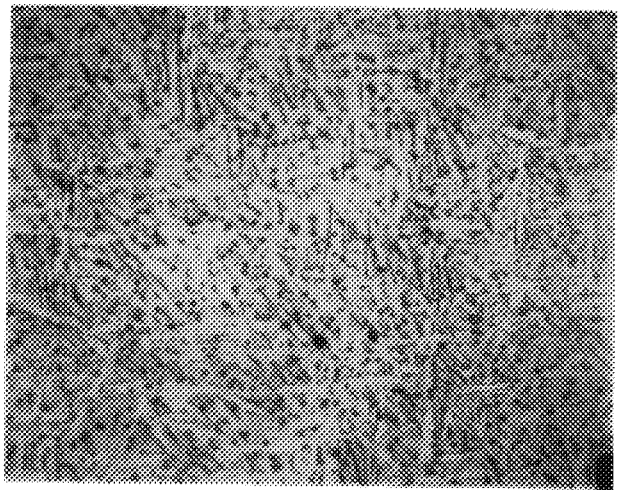
FIG. 8 is an optical photomicrograph taken at 500× magnification of a heat treated Ti/Al alloy that is identical to the alloy of FIG. 7, except that it contains 1.3 atomic percent Sn in place of an identical portion of the Al.

The alloy microstructures containing Ge are shown in FIGS. 7 and 8, and indicate that Ge plays a similar role to that of Sn. As shown in FIG. 8, alloys ZA and ZB containing Ge exhibited a post heat treatment microstructure of a transformed beta matrix with a uniform dispersoid of $Er_2O_3$ particles distributed uniformly throughout the alloy matrix. The particles had a mean diameter of less than 1 micron. In contrast, as shown in FIG. 7, alloy ZC (with neither Ge nor Sn) exhibited a heat treated microstructure of coarse particles of the dispersoid phase located in the prior beta grain boundaries. The particles had maximum diameters of up to about 6 microns.

Tensile tests were performed at room temperature, 260° C., 540° C., 650° C. and 700° C. on these alloys. The data are listed in Table IV. The alloys with Ge, ZA and ZB have higher tensile ductility at all temperatures than alloy ZC, except for the comparison of the room temperature ductilities of alloys ZA and ZC, which are nearly identical. The elevated temperature ductilities of alloys ZA and ZB are significantly greater than those of alloy ZC.

As may be see by comparing FIGS. 7 and 8, and by reviewing the data of Table IV, the substitution of Ge for Al also resulted in a refined microstructure and improved tensile ductility. These results were unexpected, and it is believed that taken in combination with the results of Examples 1 and 2, they indicate that it is likely that other Group III-B metals as well as other rare earth metals may be used to form the oxide particles (e.g. Sc, La, Ce, Pr, Nd, Pm, Sm, Eu, Gd, Tb, Dy, Ho, Er, Tm, Yb and Lu), and that other Group IV-A elements (C, Si and Pb) may be used to promote the formation of a dispersoid of an intermediate phase.

TABLE IV

Tensile Behavior of Ti/Al Alloys with Ge Additions

| | Temp. | | Yield Strength | | Ultimate Strength | | % |
|---|---|---|---|---|---|---|---|
| Alloy | °C. | °F. | MPa | ksi | MPa | ksi | Elongation |
| ZA | RT | RT | 901 | 130.7 | 948 | 137.5 | 2.9 |
| ZA | 260 | 500 | 689 | 99.9 | 738 | 107.0 | 1.2 |
| ZA | 540 | 1004 | 598 | 86.7 | 756 | 109.6 | 5.9 |
| ZA | 650 | 1202 | 541 | 78.5 | 658 | 95.4 | 11.3 |
| ZA | 700 | 1292 | 549 | 79.6 | 625 | 90.6 | 18.6 |
| ZB | RT | RT | 976 | 141.6 | 1034 | 150.0 | 7.7 |
| ZB | 260 | 500 | 780 | 113.1 | 842 | 122.1 | 1.1 |
| ZB | 540 | 1004 | 674 | 97.7 | 819 | 118.8 | 4.8 |
| ZB | 650 | 1202 | 632 | 91.7 | 738 | 107.1 | 8.9 |
| ZB | 700 | 1292 | 577 | 83.7 | 655 | 95.0 | 8.3 |
| ZC | RT | RT | 999 | 144.9 | 1018 | 147.7 | 3.1 |
| ZC | 260 | 500 | 801 | 116.1 | 803 | 116.5 | 0.5 |
| ZC | 540 | 1004 | 687 | 99.7 | 716 | 103.8 | 0.8 |
| ZC | 650 | 1202 | 670 | 97.1 | 704 | 102.1 | 1.1 |
| AC | 700 | 1292 | 613 | 88.9 | 630 | 91.4 | 0.6 |

While the examples demonstrate the applicability of the present invention to certain Ti/Al alloys, particularly those Ti/Al alloys having a concentration of Al represented by X atomic percent, where X is greater than 0, but less than or equal to about 25. The invention is believed to be generally applicable also to other Ti/Al-base alloys having a concentration up to at least 55 atomic percent Al, comprising gamma TiAl alloys, because they have properties which reflect Ti more so than Al alloys. It is further believed that the invention is generally applicable also to other Ti-base alloys. Therefore, these examples are intended merely to illustrate certain embodiments of the present invention, and not to limit the invention to specific embodiments in the form of certain alloy compositions or combinations of alloy constituents.

What is claimed is:

1. A Ti-base alloy comprising:

a first alloy constituent comprising at least one element from the group consisting of Y, Sc, La, Ce, Pr, Nd, Pm, Sm, Eu, Gd, Th, Dy, Ho, Er, Tm, Yb, and Lu, in the amount of about 0.5–3.0 atomic percent of total metals; and a second alloy constituent comprising at least one element from the group consisting of C, Si, Ge, Sn and Pb;

said alloy comprising a substantially homogeneous dispersoid of particles of at least one oxide of said first alloy constituent, said particles having a mean diameter of about 1 micron or less, said Ti-base alloy being solidified by cooling at a cooling rate sufficient to form a solidified structure with an intermediate phase within the solidified structure comprising a substantially homogeneous dispersoid of particles having a mean diameter of about 1 micron or less, said cooling rate being at least about 500° C./sec;

said second alloy constituent being present in an amount effective to form a substantially homogeneous dispersoid of particles of the intermediate phase having a mean diameter of about 1 micron or less with at least part of said first alloy constituent, the intermediate phase is subsequently decomposed by thermal processing to form said dispersoid of oxide particles, wherein said thermal processing comprises heat treating said solidified structure at an elevated temperature and for a time sufficient to cause decomposition of said intermediate phase and formation of an oxide of said first alloy constituent.

2. The alloy of claim 1 further containing Al as an alloy constituent.

3. The alloy of claim 2 wherein the concentration of Al in atomic percent is greater than 0 but less than or equal to about 55.

4. The alloy of claim 1 wherein said oxide of said first alloy constituent has the formula $[RE]_2O_3$, where RE is said first alloy constituent.

5. The alloy of claim 1, wherein the concentration of said second alloy constituent is sufficient to form an intermediate phase with substantially all of said first alloy constituent.

6. The alloy of claim 2 wherein said first alloy constituent comprises Y.

7. The alloy of claim 6 wherein said second alloy constituent comprises Sn.

8. A method for making an alloy having a substantially homogeneous dispersoid of oxide particles, comprising the steps of:

forming a melt of a Ti-base alloy comprising as a first alloy constituent, at least one element from the group consisting of Y, Sc, La, Ce, Pr, Nd, Pm, Sm, Eu, Gd, Tb, Dy, Ho, Er, Tm, Yb, and Lu in the amount of about 0.5–3.0 atomic percent of total metals, and as a second alloy constituent, at least one element from the group consisting of C, Si, Ge, Sn and Pb;

solidifying said Ti-base alloy by cooling at a cooling rate sufficient to form a solidified structure with an intermediate phase within the solidified structure comprising a substantially homogeneous dispersoid of particles having a mean diameter of about 1 micron or less, said cooling rate being at least about 500° C./sec; and heat treating said solidified structure at an elevated temperature and for a time sufficient to cause decomposition of said intermediate phase and formation of an oxide of said first alloy constituent, wherein said oxide comprises a substantially homogeneous dispersoid of particles having a mean diameter of about 1 micron or less.

9. The method of claim 8 wherein said Ti-base alloy also has Al as an alloy constituent in an atomic percent greater than 0 but less than or equal to about 55.

10. The method of claim 9 wherein said first alloy constituent comprises Y.

11. The method of claim 10 wherein said second alloy constituent comprises Sn.

12. The method of claim 10 wherein said heat treating step is performed at a temperature in the range of 500–1400° C.

13. A method for making a Ti-base alloy having a substantially homogeneous dispersoid of oxide particles, comprising the steps of:

forming a melt of a Ti-base alloy comprising a first alloy constituent of least one element from the group consisting of Y, Sc, La, Ce, Pr, Nd, Pm, Sm, Eu, Gd, Tb, Dy, Ho, Er, Tm, Yb, and Lu in the amount of about 0.5–3.0 atomic percent of total metals, and a second alloy constituent of at least one element from the group consisting of C, Si, Ge, Sn and Pb;

solidifying said Ti-base alloy by cooling at a cooling rate sufficient to form a solidified structure with an intermediate phase within said solidified structure comprising a substantially homogeneous dispersoid of particles having a mean diameter of about 1 micron or less, said cooling rate being at least about 500° C./sec;

mechanically working said structure so as to cause plastic deformation of substantially all of said alloy; and heat treating said structure at an elevated temperature and for a time sufficient to cause decomposition of said intermediate phase and formation of an oxide of said first alloy constituent, wherein said oxide comprises a substantially homogeneous dispersoid of particles having a mean diameter of about 1 micron or less.

14. The method of claim 13 wherein said step of mechanically working said alloy comprises extrusion of said alloy.

15. The method of claim 14 wherein said alloy also has Al as an alloy constituent in an atomic percent greater than 0 but less than or equal to about 55.

16. The alloy of claim 15 wherein said first alloy constituent comprises Y.

17. The alloy of claim 16 wherein said second alloy constituent comprises Sn.

18. The method of claim 13 wherein said heat treating step is performed at a temperature in the range of 500–1400° C.

* * * * *